United States Patent [19]

Maag

[11] Patent Number: 4,838,548

[45] Date of Patent: Jun. 13, 1989

[54] FOUR-BAR VARIABLE RESISTANCE LEG EXTENSION MACHINE

[76] Inventor: Henry H. Maag, 5332 Clark Cir., Westminster, Calif. 92683

[21] Appl. No.: 239,606

[22] Filed: Sep. 1, 1988

[51] Int. Cl.[4] ..... A63B 21/00

[52] U.S. Cl. ..... 272/134; 272/117

[58] Field of Search ..... 272/134, 117, 118

[56] References Cited

U.S. PATENT DOCUMENTS

| | | | |
|---|---|---|---|
| 2,855,199 | 10/1958 | Noland et al. | 272/117 |
| 3,917,262 | 11/1975 | Salkeld | 272/134 |
| 4,336,934 | 6/1982 | Hanagan et al. | 272/117 |
| 4,357,010 | 11/1982 | Telle | 272/117 |
| 4,407,495 | 10/1983 | Wilson | 272/117 |
| 4,509,745 | 4/1985 | Angsten | 272/134 |
| 4,509,746 | 4/1985 | Mask | 272/134 |
| 4,757,991 | 7/1988 | Maag | 272/134 |
| 4,790,530 | 12/1988 | Maag | 272/134 |

*Primary Examiner*—Richard J. Apley
*Assistant Examiner*—J. Welsh

[57] ABSTRACT

A leg extension exercise machine which utilizes a frame-journaled rotating effort arm, which is mechanically linked to a frame-journaled rotating weight arm, which, together with the frame of the machine and the connecting link joining them, form a simple planar double-rocking-lever four-bar linkage, which acts in conjunction with the rotating weight arm to vary the resistive force applied to the operator's leg extending muscles through body-machine contact with the rotating effort arm throughout the range of the exercise movement.

3 Claims, 4 Drawing Sheets

FOUR-BAR VARIABLE RESISTANCE LEG EXTENSION MACHINE

This invention relates to exercise equipment, in particular to a leg extension exercise machine which utilizes a four-bar linkage/rotating weight arm force-varying mechanism to apply a variably resistive force to an operator's leg extending muscles throughout the range of the exercise movement.

BACKGROUND AND OBJECTIVE OF THE INVENTION:

Present day leg extension machines all work on the same primary principle of fixing the positions of the operator's thighs (femur bones) while applying resistive forces to the operator's lower legs through circular paths about the operator's knee joints which tend to make the legs flex. The quadriceps muscles of the thighs are developed as they oppose these forces by tending to make the legs extend during the exercise movement.

It is a well known fact and easily verified that due to joint mechanics, angles of pull of muscles, physiological make-up of muscles, etc. that in a leg extension movement the least amount of force can be generated in the fully extended position while the most force can be generated in the range of 60–90 before the fully extended position. Consequently, a leg extension machine which varies the resistive force applied to correspond with the positionally related strength capabilities of the operator's quadriceps muscles as they extend the legs will be more effective at developing those muscles.

The standard method of varying the resistive force applied on present day leg extension machines is through the use of cams used in conjunction with chains or cables, all of which have inherent problems. The problem with cams is that they are relatively hard to manufacture. The problem with cables is that, because of their relatively small cross sectional area, they carry very high tensile stresses (a ⅛" cable carrying 200 lbs, for example, has a tensile stress in it of approximately 16,300 psi). These already high stresses are multiplied and become cyclic (introducing fatigue wear) when a cable moves along bending over a small diameter pulley. These high cyclic stresses, applied to relatively small cross sectional areas, make cables stretch (eventually decreasing the machine's intended range of motion) and eventually fray and wear out (leading to replacement or catastrophic failure). Chains, while not suffering the fatigue wear that cables do, are subject to stretching at their many joints (thus decreasing the machine's intended range of motion). They, also like cables, are subject to relatively high tensile stresses and in addition are noisy and introduce spurious drag to the machine.

In view of the advantages of applying a variably resistive force to an operator's leg extending muscles in a leg extension exercise movement, and the disadvantages of obtaining such a force through the use of cams, chains, or cables it is the objective of the disclosed invention to introduce a leg extension exercise machine which applies a variably resistive force to an operator's leg extending muscles through the use of a force-varying mechanism which uses only rigid members and pinned joints, thereby eliminating the problems associated with force-varying mechanisms using cams, chains, or cables.

SUMMARY OF THE INVENTION

The disclosed invention consist of a stable frame which includes provision for supporting an operator in a seated position with the positions of his thighs fixed. Journaled in this frame, on an axis which is both approximately common with the axes through the operator's knee joints and approximately parallel with the ground plane, is a rotating effort arm which includes body-machine force-transmitting contact surfaces at its distal end which engage the fronts of the operator's shins and apply resistive force from the rotating effort arm to the operator's lower legs through circular paths about the operator's knee joints throughout the range of the exercise movement, as is conventional. Also journaled in the machine's frame on an axis which is both parallel with and offset by a specific distance from the axis of rotation of the rotating effort arm, is a rotating weight arm which, as its name indicates, contains a means for loading weights onto at a point offset from its axis of rotation (as by means of either a selectorized weight stack or a conventional horizontal plate receiving bar). The rotating effort arm and the rotating weight arm are mechanically linked to each other at axes which are both parallel with and offset by specific distances from their respective axes of rotation by a rigid connecting link which also has a specific length between its centers of connection. These two rotating assemblies, the link joining them, and the frame of the machine join together to form a simple planar double-rocking-lever four-bar linkage which acts in conjunction with the rotating weight arm to vary the resistive force applied to the operator's lower legs through body-machine contact between the rotating effort arm and the fronts of the operator's shins throughout the leg extension exercise movement. Through a simple kinematic analysis, the specific lengths and orientations of the moving parts which constitute the four-bar linkage/rotating weight arm force-varying mechanism can be specified to apply a load, at the front-of-the-shin-engaging contact surfaces on the rotating effort arm, which varies in accordance with the normal strength-to-position force applying capabilities of the average operator in the leg extension exercise movement.

This invention, through the use of a kinematically derived and specified four-bar linkage acting in conjunction with a rotating weight arm, which together use only rigid members and pinned joints, applies a predetermined variably resistive force to an operator's leg extending muscles throughout the range of the leg extension exercise movement without the use of cams, chains, or cables, thereby fulfilling its objective.

DESCRIPTION OF THE PREFERRED EMBODIMENT

Figure 1:
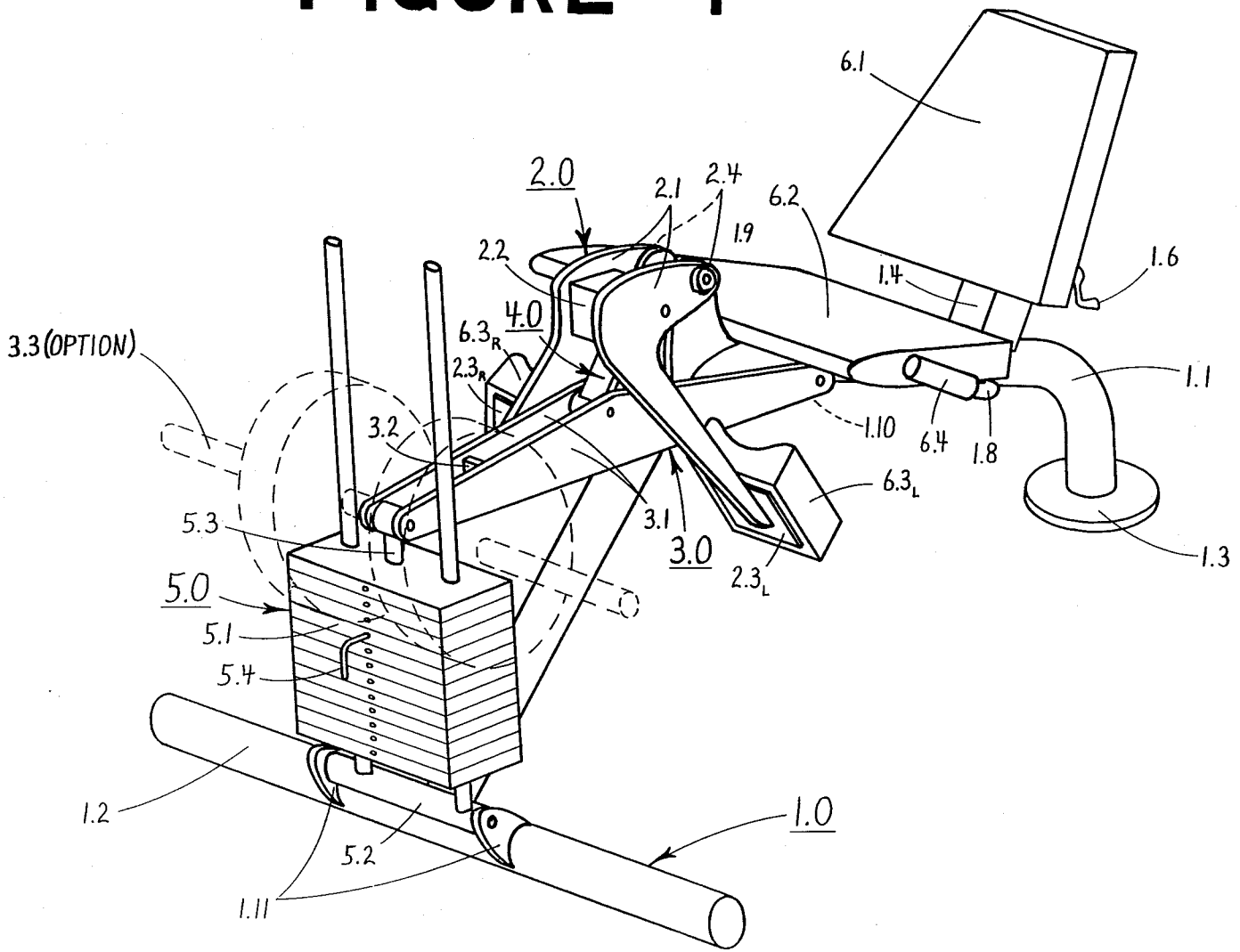
FIG. 1 is a pictorial view of the preferred configuration embodiment of the disclosed leg extension machine with all parts labeled.
Figure 2:
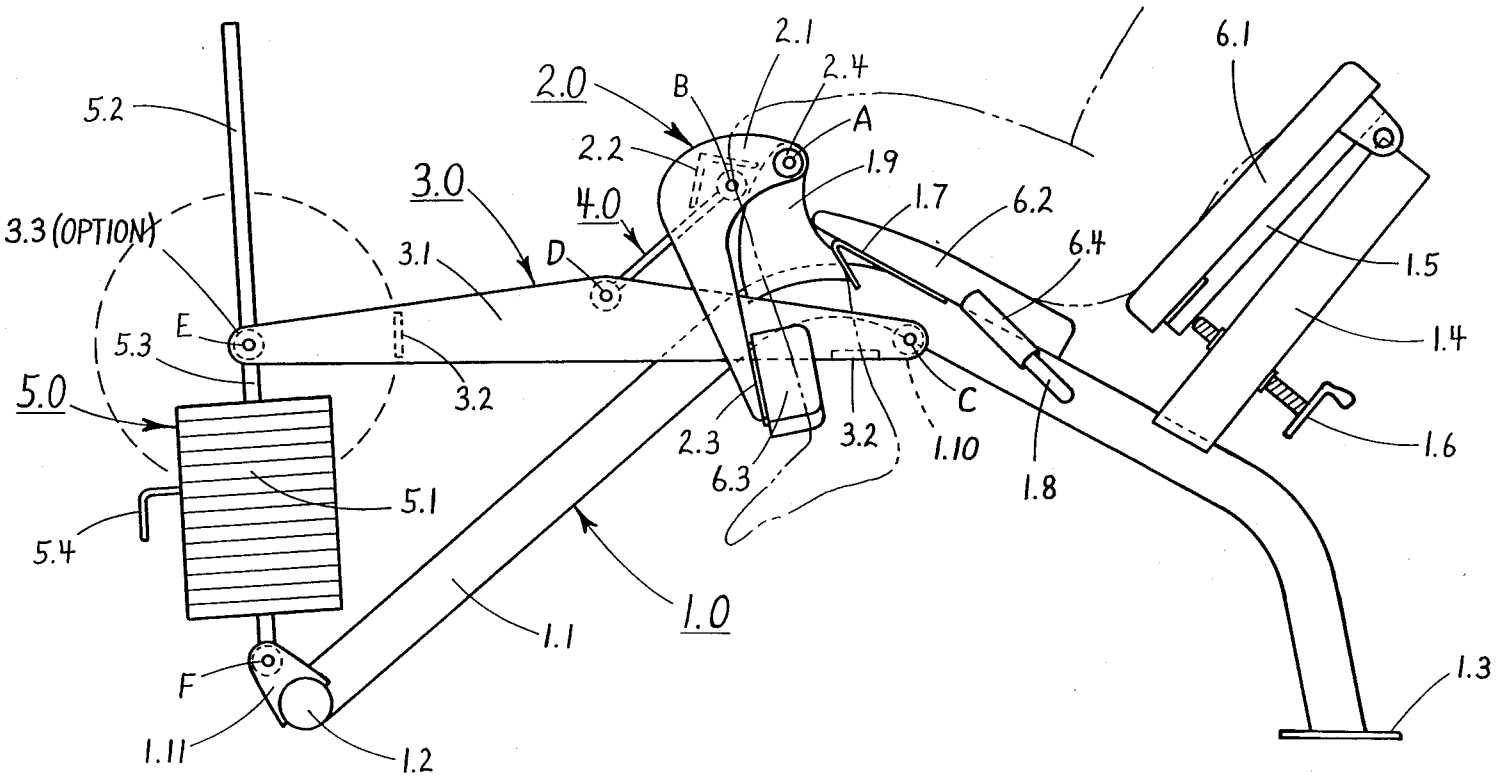
FIG. 2 is a side (plan) view of the preferred configuration embodiment of the disclosed leg extension machine with all parts labeled.

Refer now to FIGS. 1 & 2 which show corresponding pictorial and side views of the preferred configuration embodiment of the disclosed invention. In general the frame of the machine is constructed primarily of round steel tubing which is welded together at the junctions where the tubes meet as shown. Welded to this tubular steel frame are steel flanges for journaling the bearings for the moving parts and steel tabs for attaching padded body-machine contact surfaces. As shown in FIGS. 1 & 2, the primary frame of the invention (assembly 1.0) consist of an irregularly shaped bent round steel tube (part 1.1) which lies directly on the machine's plane of symmetry and joins perpendicularly into the center of a second transverse straight round steel tube (part 1.2) at its forward end. Joined to the rear open end of part 1.1 is a small round steel plate (part 1.3) which lies on the ground plane and together with part 1.2 at the forward end of the machine forms a stable triangular base for the machine. Centered on the machine's plane of symmetry and joined into the top side just in front of the top of the rear bend on part 1.1 is a short straight rectangular steel tube (part 1.4) which journals a bearing at its upper end which mounts a pivotal seat back support assembly (part 1.5) whose lower end is infinitely adjustable in distance from the axis of rotation of the machine's rotating effort arm (axis A) oweing to a screw-type adjusting mechanism (part 1.6) which is mounted toward the bottom of part 1.4 as shown in FIG. 2. Centered on the machine's plane of symmetry and mounted to this pivotal seat back support assembly (part 1.5) is a back support pad (part 6.1) which engages and constrains the operator's back while performing the exercise. Centered on the machine's plane of symmetry and mounted by the seat support bracket (part 1.7) to the top side of part 1.1 just in front of the seat back support assembly is an operator seat support pad (part 6.2) which engages the operator's seat and serves the function of supporting the operator's bodyweight while performing the exercise. Mounted transversely through part 1.1 in a position at approximately the rear of the seat support pad is a handlebar bracket (part 1.8) which mounts a pair of handgrips (parts $\mathbf{6.4}_R$ & $\mathbf{6.4}_L$) in positions where they can be gripped by the operator while performing the exercise.

Figure 3:
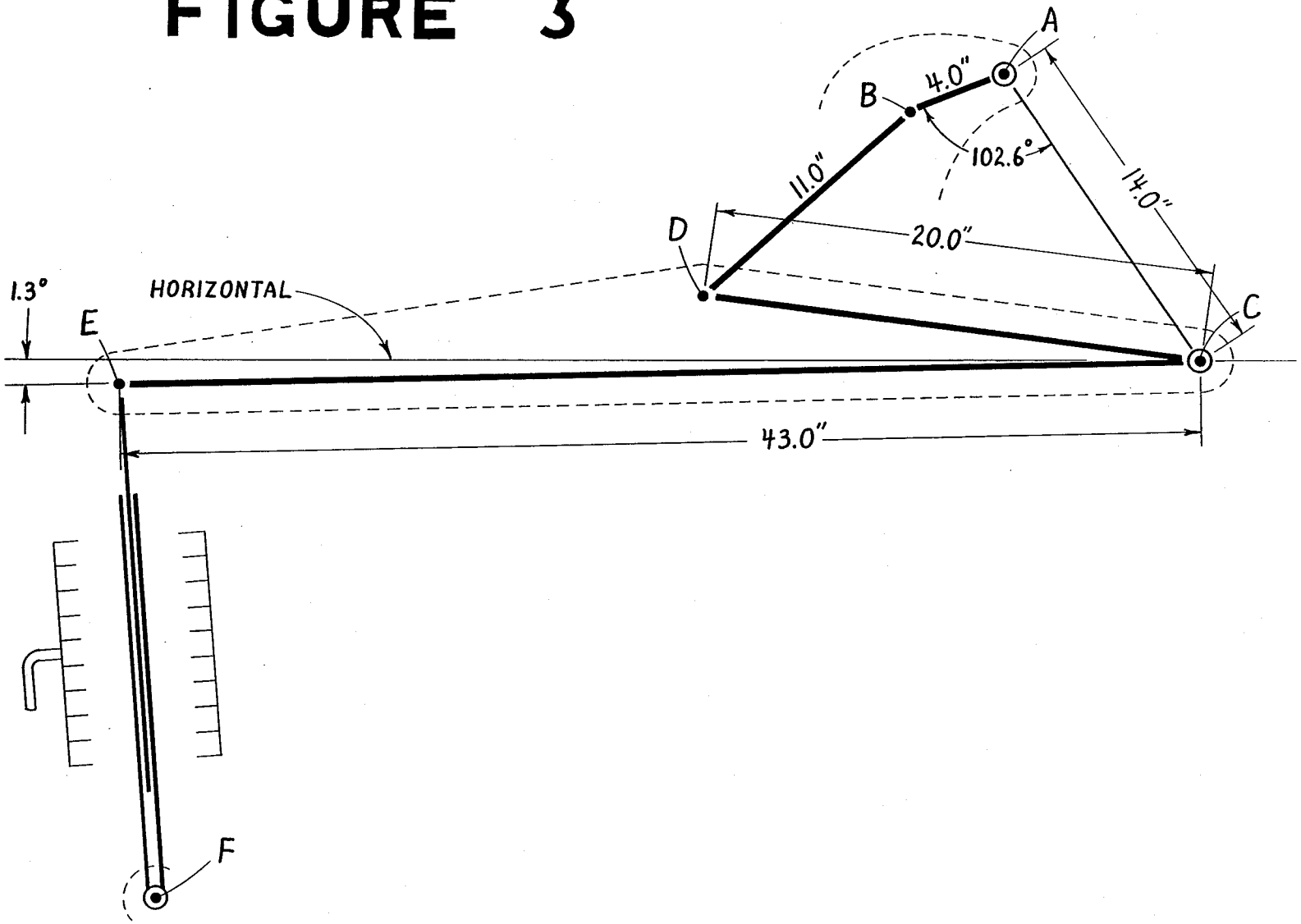
FIG. 3 is a kinematic view of the moving parts of the disclosed leg extension machine taken perpendicular to the plane in which they move showing all critical dimensions and angles at the starting position of the exercise movement.

Centered about the machine's plane of symmetry is a rotating effort arm assembly (assembly 2.0) which rotates about an axis (axis A) which is both parallel with the ground plane and positioned to be approximately common with the axes through the operator's knee joints while in the operating position. This rotating effort arm assembly is pivotally mounted to the machine's frame by a steel pin which is centered on axis A in frame-attached flanges (parts 1.9) which are located on the top side of the forward bend section of part 1.1 in a position between the operator's knee joints while in the operating position. It is composed primarily of two irregularly shaped bent steel plates (parts 2.1) which are both partially parallel with each other and symmetrical about the machine's plane of symmetry. These two bent steel plates are joined to each other at their upper parallel sections by a short section of angle iron (part 2.2) which lies transversely between them as shown. Journaled in a pair of short colinear bearing tubes (parts 2.4) which are mounted in the upper rearward ends of the upper parallel sections of these two bent steel plates are the bearings which engage the steel pin which mounts this assembly to the machine's frame at axis A. Mounted to the lower rearward sides of the bent out portions of the bent steel plates (parts 2.1) are a pair of shin pad mounting plates (parts $\mathbf{2.3}_R$ & $\mathbf{2.3}_L$) which mount a pair of right and left shin-engaging pads (parts $\mathbf{6.3}_R$ & $\mathbf{6.3}_L$) which engage the fronts of the operator's corresponding right and left shins respectively. Parallel to and offset by 4.0" from the colinear pair of bearings lying on axis A are a second colinear pair of bearings, lying on axis B, which are also journaled in the upper parallel sections of parts 2.1. This second set of bearings journals a second steel pin which is used in connecting a connecting link from the rotating effort arm assembly (assembly 2.0) to the rotating weight arm assembly (assembly 3.0). As shown in FIG. 3, the direction to axis B from axis A is along a line which forms a 102.6° angle with the line connecting axis A with axis C at the beginning of the exercise movement.

As shown in FIGS. 1 & 2, this invention contains a rotating weight arm assembly (assembly 3.0) which rotates about an axis (axis C) which is both parallel with and offset by 14.0" from the axis of rotation of the rotating effort arm assembly (assembly 2.0, axis A). Like the rotating effort arm assembly, this rotating weight arm assembly is also centered about the machine's plane of symmetry and pivotally mounted to the machine's frame by a steel pin which is centered on axis C in colinear bearings which are journaled in a short transverse bearing tube (part 1.10) which is welded into part 1.1 just below the seat pad as shown in FIG. 2. It is composed primarily of two parallel triangularly shaped steel plates (parts 3.1) which are symmetrical about the machine's plane of symmetry. These two triangularly shaped parallel steel plates are joined to each other at their forward and rearward ends by two short straight rectangular steel bars (parts 3.2) which lie transversely between their respective forward and rearward ends as shown. This assembly (assembly 3.0) is pivotally mounted to the machine's frame at its rearward end by the steel pin mentioned earlier which mounts through a pair of colinear holes drilled in the rearward ends of parts 3.1 as shown. Parallel to and offset by 20.0" from the pair of colinear holes lying on axis C are a second pair of colinear holes which are drilled in the upper center sections of parts 3.1 on axis D. This second set of colinear holes journals a second steel pin which is used in connecting the connecting link mentioned earlier from the rotating effort arm assembly (assembly 2.0) at axis B to the rotating weight arm assembly (assembly 3.0) at axis D. Attached to the forward ends of these two parallel triangularly shaped steel plates (parts 3.1) and lying on an axis (axis E) which is both parallel with and separated from the assembly's axis of rotation (axis C) by a distance of 43.0" is a weight applying means which can take either the simple form of a horizontal bar (part 3.3) for loading plate weights onto or the more complex form of a selectorized weight stack assembly (assembly 5.0) which is composed of the standard rocking weight supporting rod with spaced apertures (part 5.3) which is pivotally mounted to the rotating weight arm by a steel pin at axis E and which extends down through a set of vertically stacked weights (parts 5.1) which are free to move up and down a rocking guide assembly (part 5.2) which is pivotally attached to the front of the machine's frame in frame-attached flanges (parts 1.11) at axis F and which extends up through the set of vertically stacked weights. As is conventional, a desired quantity of weights can be quickly and easily mechanically joined to part 5.3 by operator manipulation of a weight engaging key pin (part 5.4) which extends through a selected aperture in the set of weights into a mating aperture in the pivotal weight supporting rod (part 5.3). The angle formed between the line connecting axis E with axis C and the horizontal line passing through axis C is 1.3° below horizontal at the beginning of the exercise movement as shown in FIG. 3.

As shown in FIGS. 1 & 2, the two rotating assemblies on this machine (assemblies 2.0 & 3.0) are mechanically linked to each other by a rigid steel bar (part 4.0) which contains parallel bushings at its opposite ends. One end of this connecting link connects by way of a steel pin, as mentioned earlier, to the rotating effort arm assembly (assembly 2.0) at axis B as shown in FIG. 2. The opposite end of this connecting link connects by way of another steel pin, as mentioned earlier, to the rotating weight arm assembly (assembly 3.0) at axis D as shown in FIG. 2. The distance between the axes of the parallel bushings on this connecting link is 11.0" as shown in FIG. 3.

Figure 4:
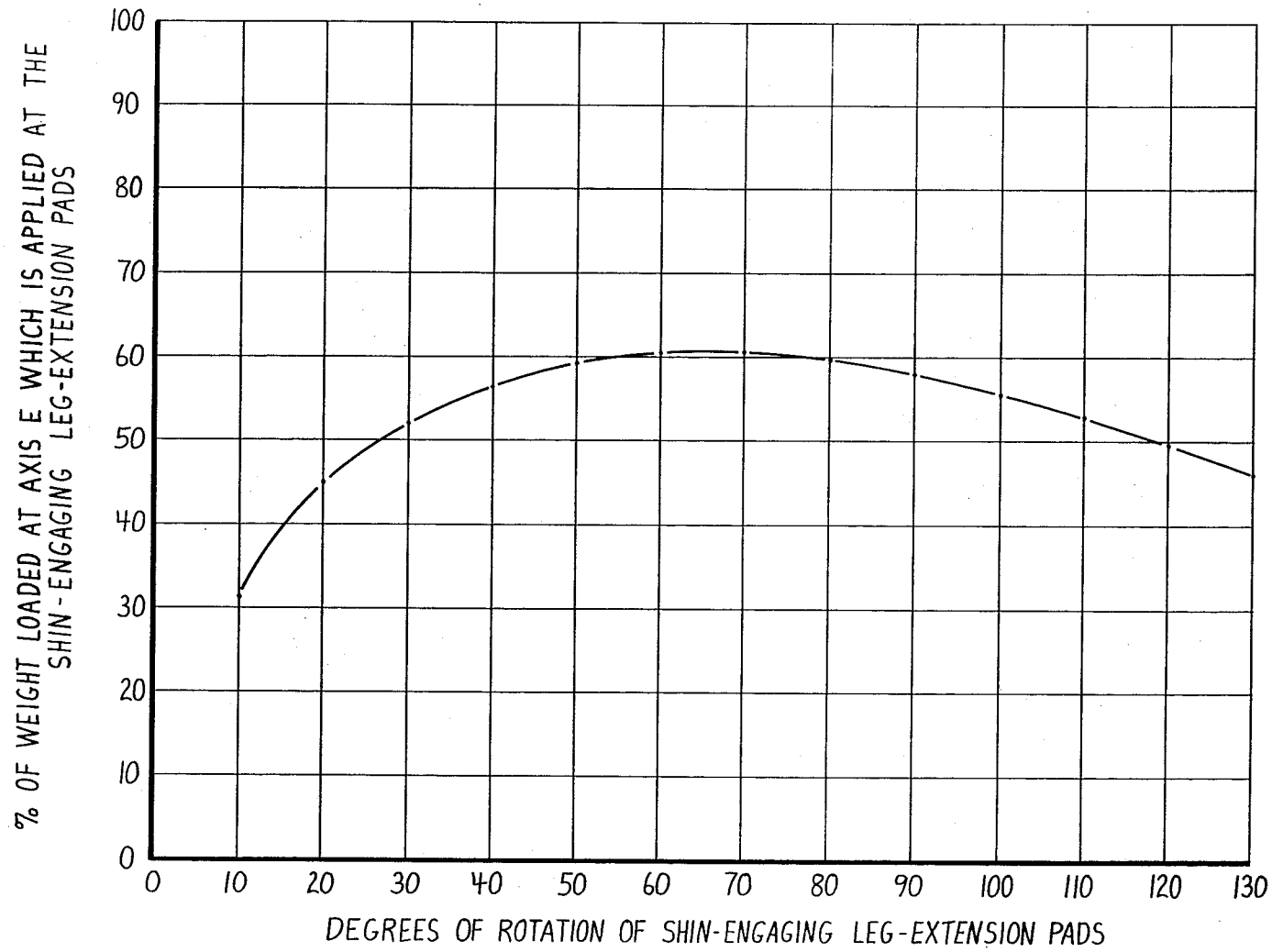
FIG. 4 is a graph generated from kinematic analysis of the force-varying mechanism composed of the moving parts shown in FIG. 3.

When the rotating effort arm assembly (assembly 2.0) is in its starting position and all angles and distances for the force-varying mechanism are as shown in FIG. 3 the corresponding output shown in the graph in FIG. 4 will be obtained while performing the exercise.

HOW THE INVENTION WORKS

As shown in FIGS. 1 & 2, this invention utilizes two rotating bodies which are journaled in a common frame and joined to each other by a rigid connecting body. These two rotating bodies (the rotating effort arm assembly—assembly 2.0 and the rotating weight arm assembly—assembly 3.0), the frame of the machine (assembly 1.0), and the rigid connecting body (the connecting link—part 4.0) join to form a simple planar double-rocking-lever four-bar linkage. This four-bar linkage whose members' lengths and orientations are as described in FIG. 3, when acting in conjunction with the sinusoidally changing values of force applied by the machine's rotating weight arm as the weight applied at axis E swings through a circular path through the gravitational field, applies, to the fronts of the operator's shins through body-machine contact with the rotating effort arm throughout the range of the exercise movement, the variably resistive force shown in the graph in FIG. 4.

CONCLUSION

This invention applies a resistive force to the fronts of the operator's shins through a circular path about his knee joints which both varies as a function of the degrees of rotation of the operator's knee joints and is correlated to the normal strength-to-position force-applying capabilities of the leg extending muscles used in the leg extension exercise movement. This resistive force is obtained through the use of a kinematically derived and specified four-bar linkage acting in conjunction with a rotating weight arm. This rotating weight arm/four-bar linkage force-varying mechanism consist of only three moving parts connected to each other and to the frame of the machine at a total of four pivotal joints making the machine inherently more reliable, less noisy, and more friction free than a comparable leg extension machine which uses cams, chains, or cables. In addition, because the machine uses no members that go through any cyclic bending (as is the case with a machine using cables) the problems associated with fatigue wear are eliminated making the machine's moving parts essentially maintainence free.

Having thus described the invention and its function, what is claimed is as follows:

1. An exercise machine which develops an operator's leg extending muscles through applying resistive forces to the fronts of the operator's shins which tend to make the lower legs move through circular paths about the knee joints in the direction of leg flexion, comprising:

a rigid frame which includes means for fixing the positions of said operator's thighs on generally parallel lines which are generally perpendicular with the axes of rotation of said operator's knee joints;

a rigid rotating effort arm which is journaled in said frame on a generally horizontal axis which is approximately common with the axes of rotation of said operator's knee joints while said operator's thighs are supported on said fixing means;

said rigid rotating effort arm includes shin-engaging surfaces which, through body-machine contact, apply resistive forces to the operator's lower legs through circular paths about the operator's knee joints;

a rigid rotating weight arm which is journaled in said frame on an axis which is both parallel with and separated by a specific distance from the axis of rotation of said rigid rotating effort arm;

said rigid rotating weight arm includes means for loading weights onto at a point offset from its axis of rotation;

said rigid rotating effort arm and said rigid rotating weight arm are mechanically linked to each other at axes which are both parallel with and offset by specific distances from their respective axes of rotation by a rigid connecting link which has a specific length between its centers of connection;

said rigid rotating effort arm, said rigid rotating weight arm, said link mechanically joining said rigid rotating effort arm and said rigid rotating weight arm, and said frame of said leg extension exercise machine join together to form a four-bar linkage which, when acting in conjunction with the sinusoidally changing values of force applied by the machine's rotating weight arm as the applied weight swings through a circular path through the gravitational field, applies a predetermined variably resistive force which varies as a function of the degrees of rotation of the operator's knee joints and which is characteristic of the relationships in length and orientation of the four rigid members forming the four-bar linkage and the orientation of the rotating weight arm to the gravitational field throughout the range of the exercise movement;

said specific distance between the axis of rotation of said rigid rotating effort arm and the axis of rotation of said rigid rotating weight arm, said specific distance between the axis of rotation of said rigid rotating effort arm and the axis of connection of said connecting link on said rigid rotating effort arm, said specific distance between the axis of rotation of said rigid rotating weight arm and the axis of connection of said connecting link on said rigid rotating weight arm, and said specific distance between the centers of connection on said connecting link all have a definite non-changing relationship to each other, which relationship, along with their orientations to each other, is determined through kinematic analysis of the moving parts of the four-bar linkage/rotating weight arm force-varying mechanism and is dependent on said predetermined variably resistive force which said four-bar linkage/rotating weight arm force-varying mechanism is designed to put out throughout the exercise movement.

2. The exercise machine of claim 1, in which said means for loading weights onto said rotating weight arm at a point offset from its axis of rotation consist of a horizontal weight supporting bar, onto which plate weights can be loaded, which lies on an axis which is parallel with the rotating weight arm's axis of rotation and which passes through said point which is offset from the rotating weight arm's axis of rotation.

3. The exercise machine of claim 1, in which said means for loading weights onto said rotating weight arm at a point offset from its axis of rotation consist of a weight supporting means which is pivotally connected to said rotating weight arm at said point offset from said rotating weight arm's axis of rotation and which extends approximately vertically downward through a plurality of weights which are slideably mounted to said machine's frame for vertical movement relative to said frame whereby a predetermined number of said weights may be mechanically attached to said weight supporting means for movement therewith.

* * * * *